US006666234B2

(12) United States Patent
Hamby et al.

(10) Patent No.: US 6,666,234 B2
(45) **Date of Patent: *Dec. 23, 2003**

(54) INSTITUTIONAL TOWEL

(75) Inventors: David Eugene Hamby, Belton, SC (US); Wilbur Mattison Rice, Belton, SC (US)

(73) Assignee: Blair Mills L.P., Belton, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/323,812

(22) Filed: Dec. 20, 2002

(65) Prior Publication Data

US 2003/0084954 A1 May 8, 2003

Related U.S. Application Data

(63) Continuation-in-part of application No. 09/745,484, filed on Dec. 26, 2000.

(51) Int. Cl.[7] ..... D03D 27/08
(52) U.S. Cl. ..... 139/396; 28/100
(58) Field of Search ..... 139/396, 383 R; 28/100

(56) References Cited

U.S. PATENT DOCUMENTS

| | | | | | |
|---|---|---|---|---|---|
| 3,721,272 | A | | 3/1973 | Hager | 139/396 |
| 3,721,273 | A | | 3/1973 | Sherrill et al. | 139/396 |
| 3,721,274 | A | * | 3/1973 | Sherrill et al. | 139/396 |
| 4,259,766 | A | * | 4/1981 | Copoulos | 19/150 |
| 4,726,400 | A | * | 2/1988 | Heiman | 139/396 |
| 6,010,789 | A | * | 1/2000 | Alston et al. | 428/397 |
| 6,062,272 | A | | 5/2000 | Waite | 139/420 |

FOREIGN PATENT DOCUMENTS

JP 61-79430 4/1986

* cited by examiner

*Primary Examiner*—John J. Calvert
*Assistant Examiner*—Robert H. Muromoto, Jr.
(74) *Attorney, Agent, or Firm*—Neil H. Hughes; Ivor M. Hughes; Marcelo K. Sarkis

(57) ABSTRACT

A colored institutional towel comprising ground warp, fill, and pile warped yarns, all of said yarns being colored by intimately draw blending a predetermined amount of predyed polyester fiber with cotton fiber when the yarn is spun and twisted to thereby form a predetermined color for the institutional towel.

32 Claims, 2 Drawing Sheets

Figure 1 - Process Flow Chart

Institutional Toweling Products may be washed unsorted, and bleached without fading or loosing their lustre. Minimal loss of absorbancy.

INSTITUTIONAL TOWEL

This is a continuation-in-part of U.S. patent application Ser. No. 09/745,484 filed Dec. 26, 2000 now allowed.

FIELD OF THE INVENTION

This invention relates to a process for the manufacture of institutional towels with the resulting towel having a much longer life expectancy.

BACKGROUND OF THE INVENTION

It is well known to manufacture towels in a process utilizing yarn spun from 100% cotton fibers. In manufacturing such a towel, the yarn is woven, as is well known, on a loom with the 100% cotton yarn being contained in the ground, fill, and pile yarns. In fact it is the 100% cotton aspect of the towel that makes it more "desirable" by the consumer since it is fixed in the mind of the purchaser that 100% cotton towels are more absorbent than other types of towels. However, when considering an institutional towel there are many drawbacks to providing 100% cotton spun yarns woven into towels since there are other issues which must be considered, which from an institutional standpoint creates disadvantages to the institution, for example a hotel chain. A hotel providing towels is a cost of doing business, thus any reductions in the cost of providing towels goes straight to the bottom line. However, cost reductions are not acceptable if customer satisfaction is sacrificed.

In manufacturing a typical towel through a continuous process, the towel is woven from the yarns accumulated on beams with the output from the loom being a continuous web of interconnected toweling product which must be bleached to remove any materials applied during the slashing process including a washing step. The toweling products that are desired to be a colour (other than a white colour) are subsequently dyed through a cold pad batch or beck dying process, washed and finally dried, then separated and finished into towels, or other terry products.

The output therefore from the process herein described includes terry products of various colours including white and other shades. For a towel or a terry product for the retail market, the consumer is quite content to wash the dyed towels without bleaching and to apply a fabric softener either in the wash or in the dryer.

However, with institutional towels the concern for the life expectancy of the towel and the sanitation of the product are very important. All institutional towels are washed with bleach time after time and as a result it can be expected that the dyed products will fade after as little as ten washings with the colour being substantially gone after twenty washings. Even with these results some hotels use dyed towels, but most feel that the fading and "colour matching" problems are not acceptable. As a rule most institutional towels are white. (Our process also enhances the ability of white products to withstand the rigors of institutional laundries and its colour retention is improved. All cotton products will become dingy over a period of time.) Over the years, most of the major hotel chains have experimented with dyed towels, in fashionable colours. Many have tried on several occasions. The outcome was a mandate by some Corporate offices to halt all use of other coloured towels and to use only white towels. Our product will have to overcome such mandates, prejudices and widely held conceptions that it is impossible to provide a coloured towel that will maintain its colourfastness.

It is known in the patent literature to provide a towel construction wherein it is suggested that yarns for ground fill, ground warp and the pile warp, although preferably being made of cotton, may also be manufactured from yarns made of blends of cotton and polyester. For example, U.S. Pat. No. 4,726,400 describes this alternative. It is also discussed within U.S. Pat. No. 4,726,400 that a checkered patent may be provided in the terry cloth by utilizing different colour yarns. There is no discussion however as to how the yarns might be manufactured and coloured. We are also aware of other constructions for towels, for example U.S. Pat. No. 3,721,273 discusses in the Background of the Invention a preference of cotton and alternatively that synthetic fibers may be blended with the cotton fibers. Rayon yarns are also discussed in relation to their absorbency in that the rayon may be woven into the towel in the form of a 3-pick terry weave. U.S. Pat. No. 3,721,272 discusses that terry yarns have been formed of shrinkable synthetic fibers blended with cellulosic fibers, such as cotton. U.S. Pat. No. 3,721,274 teaches a woven terry towel wherein the ground warp and/or the filling yarns are composed of a blend of polyester and cellulosic fibers, but the terry pile is manufactured from 100% cotton. Within the reference it is stated that polyester has been heretofore considered an undesirable fiber for use in terry towels due to its low moisture absorbency characteristics. In fact, U.S. Pat. No. 6,062,272 issued May 16, 2000 teaches an all cotton pile with polyester being in the ground fabric. The pile yarns although desirably all cotton may include small quantities of other fibers such as polyester or rayon which would result in a corresponding decrease in the absorbency of the finished towel product. Specifically in the examples various compositions are described.

However, in spite of the general discussions in the above-mentioned patent literature there is no discussion of the present problems facing the institutions which purchase institutional towels. In none of the above patents, is colourfastness or longer life mentioned.

Our unique product provides many benefits to institutional towel users. However our principal objective is to provide a towel that will exceed current experience and expectations by providing a towel which will both (i) retain its colour and (ii) yield longer life expectancy, even when harsh chemicals are used in the laundering process.

It is a further object of this invention to provide an institutional towel and related toweling product which is the result of a manufacturing process resulting in minimum variation from batch to batch of the final product colour.

It is a further object of this invention to provide an institutional towel ensemble {i.e. all sizes} which includes a matching set of toweling products having very little colour variation from item to item in the ensemble.

It is a further object of this invention to provide a process of manufacturing an institutional towel which eliminates the need to dye the towel at the towel mill and thus eliminates the effluent waters created when dyeing product.

Further and other objects of the invention may become apparent to those skilled in the art when considering the following summary of the invention and a more detailed description of the preferred embodiments illustrated herein.

SUMMARY OF THE INVENTION

In the following definitions of various aspects of the invention colour is defined as any possible colour shade including various shades of white. Polyester has a raw colour of grey.

According to a primary aspect of the invention there is provided a process for manufacturing institutional terry/toweling products comprising the steps of:

1. providing cotton fibers;
2. providing pre-dyed polyester fibers;
3. orienting the fibers of the cotton in substantially a uniform parallel direction by carding;
4. orienting the pre-dyed polyester fibers in substantially parallel direction by a carding process;
5. draw blending the cotton and pre-dyed polyester fibers in a slivering process, in one embodiment in a ratio of 8 to 14% of the pre-dyed polyester fibers with the balance being the cotton fiber; in another embodiment in a ratio of less than or equal to about 5% of the pre-dyed polyester fibers with the balance being the cotton fiber; in yet another embodiment in a ratio of less than or equal to about 8% of the pre-dyed polyester fibers with the balance being the cotton fiber; in yet another embodiment in a ratio of about 25–35% and preferably less than or equal to about 30% of the pre-dyed polyester fibers with the balance being the cotton fiber; in another embodiment in a ratio of about 45–55% and preferably less than or equal to about 50% of the pre-dyed polyester fibers with the balance being the cotton fiber;
6. following the intimate draw blending of the pre-dyed polyester and cotton fibers spinning the slivered fibers into twisted yarns having a pre-determined colour which will be imparted to the toweling product;
7. accumulating the yarns on a loom beam following warping/slashing the yarns in preparation for the weaving process;
8. weaving said coloured yarn into the ground warp, the fill and the pile warp yarns in the toweling product which preferably is a continuous process;
9. preferably bleaching and subsequently washing and drying said toweling product prior to finishing;

wherein the colour in the product is obtained by the weaving process only (by using coloured yarns) with no subsequent dying process being necessary and wherein the resulting products have:

i) a minimum colour variation from batch to batch, ii) are colour fast, the colour being imparted to the product by the pre-dyed polyester fiber allowing all products resulting from this process to be able to be washed and handled together, iii) a significantly longer life expectancy of the product imparted by the polyester fiber, and iv) the ability of the product to be manufactured into a matching set having minimum colour variation from product to product.

In order to obtain the benefits of the higher percentage of polyester (ie: 50/50 mats, etc.) we utilize a blend of 2 different colours of pre-dyed polyester to be certain the colour matches the other pieces of the ensemble. For instance the ensemble may be the Ecru colour. The bath towel may be 14% brown polyester. The tub mat may be overall about 45–55% and preferably less than or equal to about 50% overall polyester, but we will still use for example 14% brown and 36% white polyester to maintain the proper colour matching. The different parts of ensemble have different absorbency requirements thus the polyester % may change from one to the other.

The resulting product from this process overcomes all of the deficiencies and problems experienced in the institutional towel industry with dyed terry products, and makes available a new opportunity for hotels not to be forced into "white only." This process also improves the white products, by providing longer life and improved colour retention.

The colour in our institutional terry/toweling products has been imparted to them by spinning yarns of a drawn blend of pre-dyed polyester fibers and natural cotton fibers. The resulting product therefore is many times more colourfast as compared to those dyed in conventional manners. Typically as discussed in the background section above, towels would usually "survive" only approximately twenty washes before one might expect the colour to be significantly altered. The experimental towels originally produced utilizing the invention did not fade and retained their colour through 150 wash cycles.

Since filing our first co-pending application and the introduction of Fibertone products, we have found other beneficial characteristics that stem from Fibertone's unique construction. These benefits are not obtained by simply increasing the level of polyester in the product, but by the strategic placement of the increased polyester, as we have set forth in this disclosure. The success of Fibertone in commercial use and test results have started to dispel commonly held beliefs or theories of market acceptance regarding "how a towel must be constructed" and "what is acceptable." This has prompted us to expand the boundaries we previously set in our original Patent Application.

Heavier Towels

Recently, we have seen a demand for larger and heavier towels. This market trend is not a result of the smaller and/or lighter towel's inability to absorb the desired volume of water, but is the result of an effort to market an image in a customer's mind linking "big and heavy" with a higher quality product reflecting on the class of the institutional establishment.

Since additional absorbency is not the primary objective of increasing the size/weight of the product, we have chosen to add the desired weight to the heavier product by including additional polyester (about 25–35% and preferably less than or equal to about 30%) as opposed to cotton {which normally would be favored if one were attempting to increase absorbency}. When our method of towel construction set out above is carried out to add the polyester all of the benefits described in our co-pending Patent Application are realized including:

Dramatic decreases in linting.

Reductions in laundry cost (mainly in drying).

Greater longevity.

All of these benefits are even more dramatic with increased levels of polyester.

Tub Mats

Tub mats have always represented a handling problem in a laundry system. Their typical heavier weight construction results in the mats do not dry in the same time as the toweling. Therefore they must be sorted at the end of a drying cycle and run through another cycle. We have varied the polyester percentage in the yarns up to about 45–55% and preferably less than or equal to about 50% for tub mats in an effort to equalize drying times and institutional customers are very pleased with the results. Equalizing the drying time removes a major problem for their laundries. This market sector is not as sensitive to the loss in absorbency of a tub mat as a result of decreasing the amount of cotton in the mat as has been past experience with towels; since a mats primary function is to catch water from the body dropped onto the floor as opposed to actually drying the body. Higher polyester percentages in mats are therefore are more readily accepted by the market since the product is not handled to the same extent as a towel.

Low Lint Towels

For some of our current toweling product ensembles, we have been varying the polyester percentages to up to about 25–35% and preferably less than or equal to about 30%. One of our distributors has been quite enthusiastic about the higher polyester content toweling products that he requested exclusive rights to this product for specific markets. The product benefits and the associated reduction in risk of fire in the laundry has been very well received in the healthcare and cruise line industries among others and their particular desire to reduce the lint generated from cotton fibers breaking away from a toweling products.

100% Cotton Towels

We have discovered in spite of our best efforts that there are buyers, regardless of our products benefits, that are not willing to change from a 100% cotton towel ensemble. It is their position that the 100% cotton product provides an image of superior performance and high quality in the minds of their customers. Therefore they do not purchase anything other than 100% cotton products.

However, these very same customers desire the colourfastness achieved with FibertoneTM products. We were not successful initially, as of about December 2000, in obtaining even shades of colour when using polyester percentages below 8%. With selected colours, we have been able to produce a good quality of colour with less than or equal to about 8% polyester. We are now manufacturing a towel with less than or equal to about 5% "solution dyed polyester". There are no basic benefits to this product, other than colourfastness. Since the polyester serves as no enhancement to the towel, other than colour, it is considered "ornamentation." Thus the product can be labeled as 100% cotton, according to the labeling laws, and will meet the needs of this group of customers. The label reads "100% cotton (exclusive of 5% polyester ornamentation)".

Institutional terry/toweling products described herein may be for example institutional towels, whether hand, bath, face, wash cloth or the like, tub mats, heavier towels, or "100%" cotton toweling as described above.

According to yet another aspect of the invention there is provided an institutional terry/toweling product for example those described above (and preferably manufactured from the above-mentioned process) which comprises coloured yarns draw blended of a pre-determined amount of pre-dyed polyester fiber (as set out above) with the remainder being natural cotton fibers resulting in a yarn of pre-determined colour, said product having ground warp, fill, and terry loop fibers manufactured from said yarn resulting in said product having a pre-determined colour which is colour fast, has little variance from lot to lot, may be washed and bleached, is conveniently handled by an institution, has an increased life expectancy imparted by the polyester, and which has reproducible colour of the finished product from batch to batch.

It is therefore expected that other colours other than a vanilla (ecru) colour obtained with the 14% brown pre-dyed polyester fiber may also be manufactured. Pastel shades of blue, red, green or the like may be manufactured in the form of an institutional product which is superior when compared to known institutional towels of all cotton construction in terms of convenience and handling through the washing and bleaching cycles with the resulting increase in life expectancy while maintaining its colour and luster. The colour is reproducible from batch to batch and from product to product so that complete bath ensembles can be provided to the institution with matching colours from the face cloth, the bath towel and the hand towel and the bath mats.

According to yet another aspect of the invention there is provided a method of colouring an institutional terry/toweling product comprising weaving said product from twisted yarn spun from an intimate, drawn blend of a predetermined amount of pre-dyed polyester fiber, (preferably in the range of 8–14%, with the balance being cotton fiber, in another embodiment in a ratio of less than or equal to about 5% of the pre-dyed polyester fibers with the balance being the cotton fiber; in yet another embodiment in a ratio of less than or equal to about 8% of the pre-dyed polyester fibers with the balance being the cotton fiber; in yet another embodiment in a ratio of about 25–35% and preferably less than or equal to about 30% of the pre-dyed polyester fibers with the balance being the cotton fiber; in another embodiment in a ratio of about 45–55% and preferably less than or equal to about 50% of the pre-dyed polyester fibers with the balance being the cotton fiber) said coloured yarn thereafter being spun from said drawn blend and all of said ground yarns, fill yarns and pile yarns making up said product being formed from said drawn blended twisted coloured yarn to form said product which has the properties of: 1) being colourfast; 2) being consistent in colour from batch to batch; 3) being consistent in colour from product type to product type, for example, for a bath towel, face towel, wash cloth, bath robe or bath mat; 4) being capable of being bleached and washed without fading or loosing it's luster; and 5) having an extended life expectancy.

According to yet another aspect of the invention there is provided an institutional terry/toweling product, preferably manufactured from the above method, comprising twisted yarn spun from an intimate, drawn blend of a predetermined amount of pre-dyed polyester fiber, (preferably in the range of 8–14%, in another embodiment in a ratio of less than or equal to about 5% of the pre-dyed polyester fibers with the balance being the cotton fiber; in yet another embodiment in a ratio of less than or equal to about 8% of the pre-dyed polyester fibers with the balance being the cotton fiber; in yet another embodiment in a ratio of about 25–35% and preferably less than or equal to about 30% of the pre-dyed polyester fibers with the balance being the cotton fiber; in another embodiment in a ratio of about 45–55% and preferably less than or equal to about 50% of the pre-dyed polyester fibers with the balance being the cotton fiber), said coloured yarn thereafter being spun from said drawn blend and all of said ground yarns, fill yarns and pile yarns making up said product being formed from said drawn blended twisted coloured yarn to form said product which has the properties of: 1) being colourfast; 2) being consistent in colour from batch to batch; 3) being consistent in colour from product type to product type, for example, for a bath towel, hand towel, wash cloth, bath robe, or bath mat; 4) being capable of being bleached and washed without fading or loosing it's luster; and 5) having an extended life expectancy.

The aspect of providing a colour within an institutional product is a considerable improvement for the hotel industry which no longer will be required to supply only white products or run the risk of having considerable expense if coloured products are selected. By providing a product made by the above-mentioned method any pastel shade can be manufactured including vanilla, pink, light blue, light green, grey and any other pastel type of shade without sacrificing a great deal of absorbency in the product. It is considered that the advantages of such an institutional product or for that matter a coloured towel in the retail trade are more than offset by the minimal loss in absorbency.

According to another aspect of the invention there is provided a coloured institutional terry/toweling product comprising ground warp, fill, and pile warped yarns, all of said yarns being coloured by intimately draw blending a predetermined amount of pre-dyed polyester fiber with cotton fiber when the yarn is spun and twisted to thereby form a predetermined colour for the institutional product. Preferably said predetermined amount of pre-dyed polyester fiber in one embodiment being in the range of 8–14%, in another embodiment in a ratio of less than or equal to about 5% of the pre-dyed polyester fibers with the balance being the cotton fiber; in yet another embodiment in a ratio of less than or equal to about 8% of the pre-dyed polyester fibers with the balance being the cotton fiber; in yet another embodiment in a ratio of about 25–35% and preferably less than or equal to about 30% of the pre-dyed polyester fibers with the balance being the cotton fiber; in another embodiment in a ratio of about 45–55% and preferably less than or equal to about 50% of the pre-dyed polyester fibers with the balance being the cotton fiber.

For a preferred vanilla towel the twisted yarn includes a predetermined amount of predyed polyester fiber having a predetermined denier, and tenacity and fiber length. No limitations however to these variables is contemplated for use in the institutional towel. For the vanilla towel the predyed polyester fiber has a beige colour but as discussed it may have a different colour depending on the shade of towel desired. The colour of the predyed polyester is established by trial and error, and specified by a matching comparison with a coloured swatch. The predyed polyester/cotton draw blended twisted yarn is manufactured with a predetermined twist (turns per inch) in the yarn. The ground and fill yarns may or may not have substantially the same twist as the pile yarns although they are of course of the same colour.

DETAILED DESCRIPTION OF THE PREFERRED EMBODIMENTS

Our development team did extensive research and gathered information by communicating with people in the laundry business and institutional towel users. Based on these efforts, we believe these five statements to be fact:

1 Towel quality is a key indicator to the customer of the quality of the establishment utilizing the towel.
2. Coloured towels, of a specific construction, are perceived as higher quality than white towels, of the same construction.
3. Towels, which are not exposed to harsh chemicals, such as bleach, have a longer life expectancy. Discussions with many laundry managers, say this can be as much as 30% to 60% longer. This additional life expectancy varies greater with regard to the volume of chemicals used and the quality of the laundering equipment.
4. White towels must be bleached repeatedly to maintain their whiteness and for sanitary reasons.
5. Coloured towels fade at a more rapid pace when bleach is used.

Being proactive with respect to the above facts, our product development team has developed our "FIBERTONE™" product which will not fade or bleed throughout the structural life of the towel, even when harsh chemicals are used. Fibertone products also have a longer life expectancy than 100% cotton products and conventionally constructed poly/cotton blends.

There are many other advantages of FIBERTONE™ towels.

1. Improved appearance of the pile yarn, during the life of the towel.
2. Added stability in the selvage area.
3. Less linting.
4. Environmental friendliness.
5. Allows a reduction in laundry cost.
6. Our towels can be laundered with white towels. They will not bleed.
7. The "batch to batch" and "style to style" colour matching of "FIBERTONE™" towels is greatly enhanced.
8. The service people at the hotel will not have the task of sorting the different shades of towels (this is necessary due to the present coloured towels being used at different stages of their life).
9. Sufficient absorbency is maintained.
10. Allows the consumer to economically upgrade from white to vanilla.
11. Allows the consumer to save money, even after allowing for the theft rate.

FIBERTONE™ is a trade mark of Blair Mills L.P.

Figure 1:
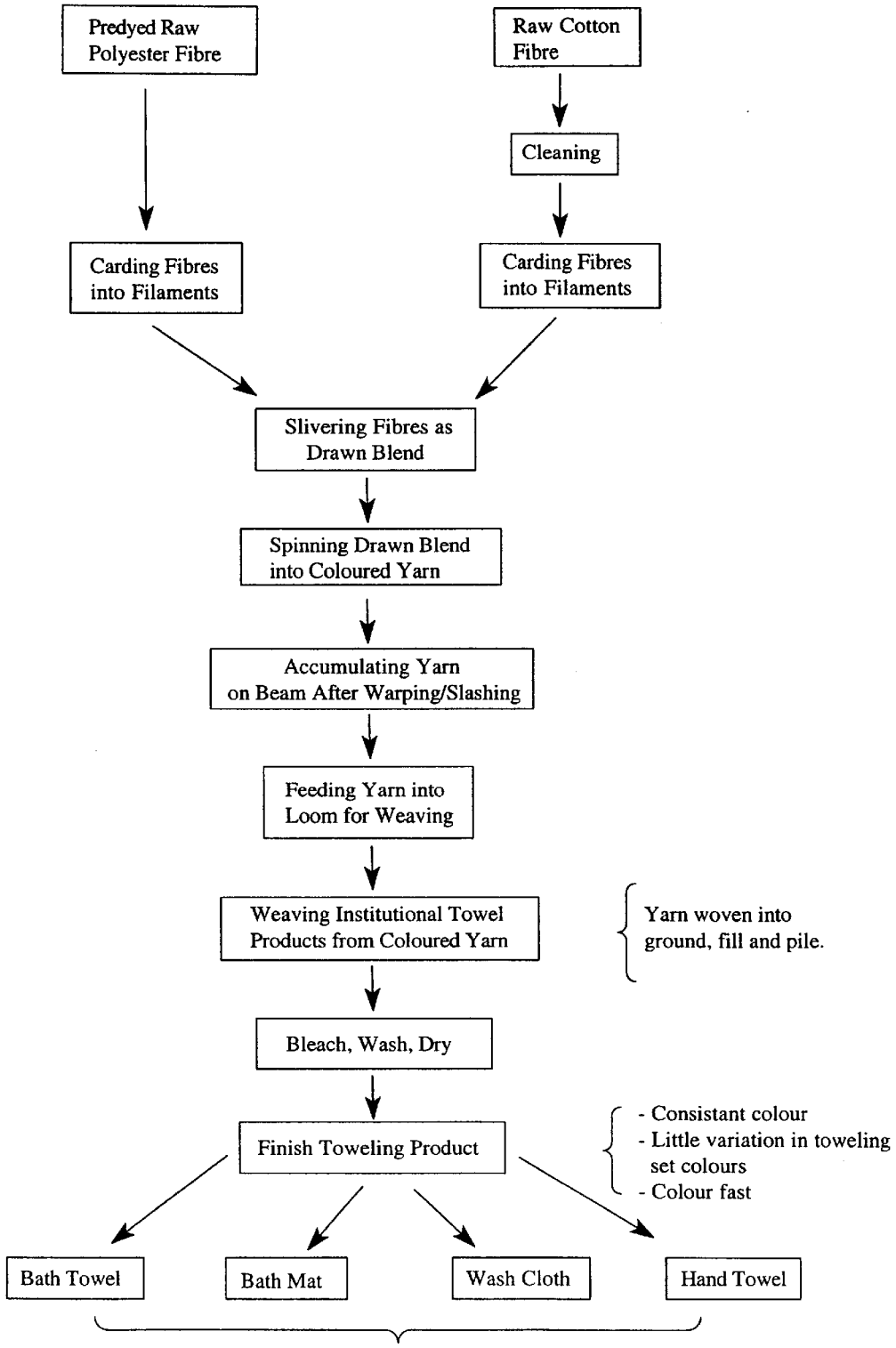
FIG. 1 is a flow chart of the Process of Manufacture of the present invention utilized in the manufacture of the Institutional Towel thereof.
Figure 2:
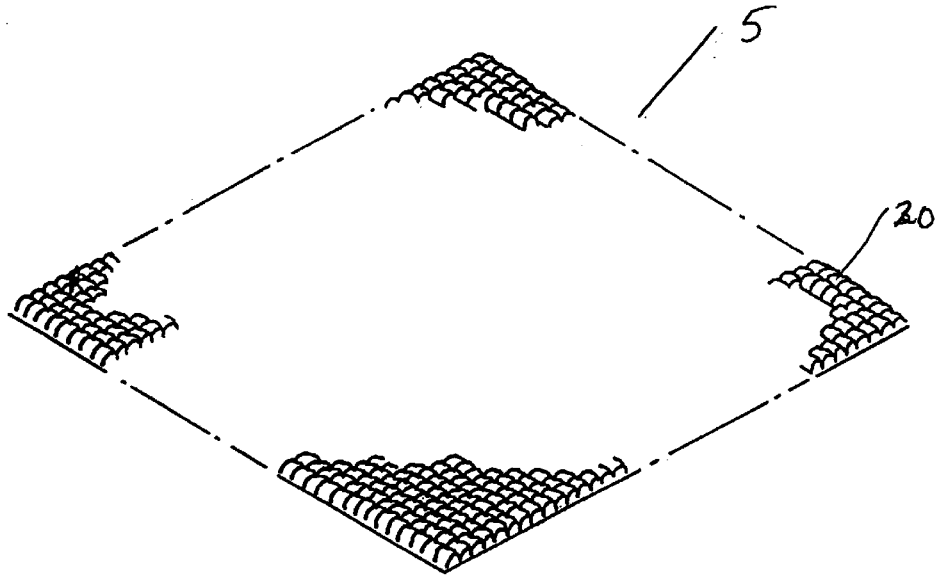
FIG. 2 is a schematic perspective view of the towel product manufactured from the process steps of FIG. 1.

Referring to FIG. 1, a process flow chart is illustrated which describes the manner in which the Institutional Towel is manufactured. The towel product (5) therefore of FIG. 2 is manufactured so as to overcome many of the deficiencies in prior institutional towels. As discussed in the Background of the Invention, most institutional towels are white because otherwise they would not stand up to the washing and bleaching cycles. It is appreciated that a towel product in a hotel, for example, would be washed on a daily basis. Should these towels and various towel products such as wash cloths, hand towels, bath towels, bath mats, bath robes, etc. be coloured, as is desirable, then they would have to be sorted out from the regular laundry flow and could not be subjected to bleaching. However, if they are not sorted then these toweling products would not stand up and the colour would fade by approximately 20 cycles.

Therefore, to address this problem, the present invention provides an Institutional Towel that is preferably vanilla in colour but may be other pastel shades such as grey, light blue, light green, yellow or the like. The toweling product formed by carrying out the process of FIG. 1 will have the preferred vanilla colour and will have very little shade variance from batch to batch of towels, and from batch to batch of matching toweling products making up a bath assemble. This minimum variation from batch to batch and from toweling product to toweling product is important especially after many washing cycles. It is desirable that the product stand up to the rigors of such washing and bleaching cycles and yet not fade, yet still matching the colour for the bath mat, bath towel, face towel, and wash clothes. It is also a result of this invention that the product is coloured without the necessity of carrying out a dying process at the towel mill. The resulting towel product stands up to many, many washings because of the extra strength imparted to the yarns by the presence of polyester. The polyester is distributed throughout the towel having been blended with cotton in manufacturing the yarn and therefore this strength and resilience of the product is distributed throughout all of the yarns including the ground, fill and pile yarns.

Referring to FIG. 1, the polyester is purchased in raw fiber form, with the fibers having been pre-dyed in this example to a brown colour, which when blended with the cotton fibers will result in a yarn having a vanilla colour. The materials are received in bales and the fibers are somewhat compacted as received. The fibers therefore must be separated sufficiently so as to be able to be properly handled. As is known, the cotton is cleaned. Once the fibers have been broken down in the sense that they have been separated and the bulk density thereof has been drastically reduced, they are in the form that they can be passed through a carding machine in order to take the fibers that are randomly distributed in the pre-dyed polyester and the cotton and to orient them in a generally parallel direction. The result of the carding process is that the fibers are laid out in a parallel direction in a long extended, untwisted rope like element. This is the case with both the pre-dyed polyester and the cotton. The continuous filaments therefore, having been carded are then accumulated to be fed through a slivering machine, and is utilized to create an intimate draw blend of the cotton and pre-dyed polyester carded fibers. The products are slivered together, that is to say draw blended, at a ratio of between 8 to 14% polyester, and the remainder being cotton. The resulting slivered element is continuous and is of considerable larger diameter than the prior carded products. The slivered continuous elements are therefore accumulated and fed into a yarn spinning machine, and the yarn product is spun from the intimately draw blended slivered mixture of polyester and cotton. The resulting twisted yarn is then accumulated again and processed through a warping/slashing process and coated with a compound to enable the yarn to stand up and impart to it a certain robust quality required during the weaving process. The yarn is therefore accumulated on a beam and fed to a loom for the toweling product to be manufactured. The ground yarn, the fill yarn and the pile yarns are all manufactured from the same coloured yarn intimately draw blended to provide the preferred vanilla colour. The resulting towel products are therefore finished and prepared for distribution, once the towels have been washed in caustic and bleached to remove the coating compound and dried to enable finishing. The resulting toweling products therefore have all of the desired qualities of the institutional towel product previously discussed with an unexpectedly much longer extended life than what might have been expected from the use of a draw blended yarn product that is pre-coloured. The towel product is therefore coloured without the necessity of including the dye step in the towel manufacturing process and the handling of chemicals required in order to do so. The safety within the mill therefore is enhanced and the product has proven by experimentation to be much superior to previously known institutional towels and towel products.

Figure 3:
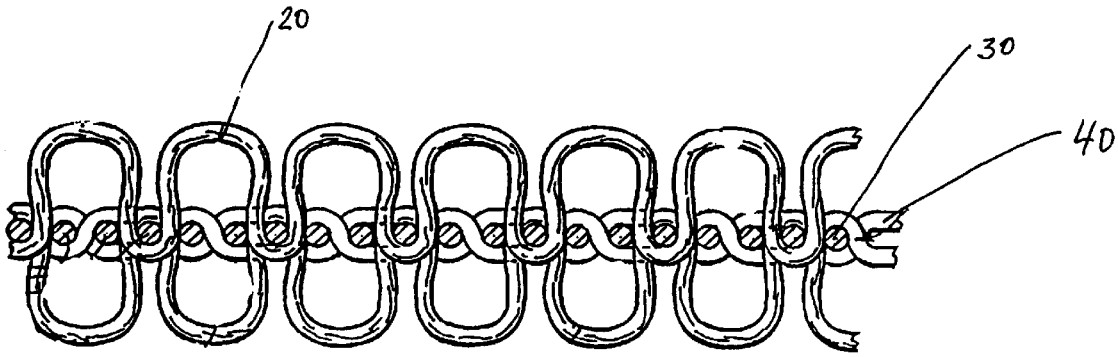
FIG. 3 is a close up perspective view of the yarn elements and how they are woven into the terry product illustrated in FIG. 2.

The coloured towel product (5) is illustrated in FIG. 2 with the preferred three pick weaving step shown in close up in FIG. 3 with all of the yarns shown in FIG. 3 therefore including the vanilla colour draw blended twisted yarn previously manufactured at the yarn mill. The towel product therefore includes the pile coloured yarns (20) the ground coloured yarns (30) and the fill coloured yarns (40) which are woven in a manner as is well known on a loom. All of the yarns are those which have a vanilla colour and contain an intimate draw blend of polyester and cotton. The coloured towel product preferably includes 75 threads per inch for the pile yarn, 60 threads per inch for the fill yarn and 45 threads per inch for the ground yarns. Up to three pile picks may be woven between two adjacent weft yarns of ground fabric. The result is a towel without an increase in the amount of polyester therein, but a different significant distribution which imparts the significant advantages identified above.

For the preferred vanilla towel (5) the twisted yarn (20, 30, 40) includes a predetermined amount of predyed polyester fiber having a predetermined denier, and tenacity and fiber length. No limitations however to these variables is contemplated for use in the institutional towel. For the vanilla towel (5) the predyed polyester fiber has a beige colour. The colour of the predyed polyester is established by trial and error, and specified by a matching comparison with a coloured swatch. The predyed polyester/cotton draw blended twisted yarn (20, 30, 40) are manufactured with a predetermined twist (turns per inch) in the yarns. The ground and fill yarns (30, 40) may or may not have substantially the same twist as the pile yarns (20) although they are of course of the same colour.

In relation to life expectancy it has been, through experimentation, proven that such a towel manufactured for experimental purposes has undergone 150 washes with bleaching, but it has not lost it's luster and has not faded in spite of having been bleached. The towel was manufactured from the drawn blend yarn of a vanilla colour. In early 2001 the University of Kentucky carried out experimental testing on our inventive Fibertone™ product in comparison to a VAT dyed institution towel manufactured by Blair Mills. The Fibertone™ product tested included 5% pre-dyed polyester and 95% raw cotton fibers. Although the test results were extremely gratifying. It was recommended that an 8% pre-dyed polyester would be preferred for reproducible colour uniformity if this was an issue depending on the product and to avoid the risk of splotchy or mottled colour in the product. An upper 14% range was established by sound prediction based on the desired colour, absorbency, and resilience in the towel, and through further experiments at that time. The results have been more than gratifying, and the Fibertone™ product has found good acceptance in the marketplace. The Fibertone™ towel unexpectedly maintained its colour through 150 washing cycles. The Ecru (vanilla) VAT dyed institutional towel experienced colour change after just 10 wash cycles, and a significant colour change after 25 wash cycles. All other measurable factors were as expected and the overall colour fastness of the Fibertone™ product was excellent and far exceeded the colourfastness of the Ecru VAT dyed towel. "Even after 150 institutional laundry cycles the Fibertone™ towel experienced no apparent colour loss - - - ".

The 8%–14% pre-dyed polyester range provides a balance in the Fibertone™ product to obtain acceptable colour uniformity while maintaining good absorbency. Other percentage ranges on either side of 8%–14% pre-dyed polyester range are possible and we have conducted further work to explore these areas.

The products, constructed according to our co-pending patent application (from this point referred to as Fibertone), experience colourfastness in all blend levels from 1% to 100%. In our original patent application, we set a range of 8% to 14% as a preferred level of polyester. The lower limit of 8% was set due to our inability as of December 2000 to get an even shade of colour outside this range. The higher limit of 14% was set, based on experience, to a level that the market has deemed acceptable as a poly/cotton blend.

Since filing our first co-pending application and the introduction of Fibertone products, we have found other beneficial characteristics that stem from Fibertone's unique construction. These benefits are not obtained by simply increasing the level of polyester in the product, but by the strategic placement of the increased polyester, as we have set forth in this disclosure. The success of Fibertone in commercial use and test results have started to dispel commonly held beliefs or theories of market acceptance regarding "how a towel must be constructed" and "what is acceptable." This has prompted us to expand the boundaries we previously set in our original Patent Application.

Heavier Towels

Recently, we have seen a demand for larger and heavier towels. This market trend is not a result of the smaller and/or lighter towel's inability to absorb the desired volume of water, but is the result of an effort to market an image in a customer's mind linking "big and heavy" with a higher quality product reflecting on the class of the institutional establishment.

Since additional absorbency is not the primary objective of increasing the size/weight of the product, we have chosen to add the desired weight to the heavier product by including additional polyester (about 25–35% and preferably less than or equal to about 30%) as opposed to cotton {which normally would be favored if one were attempting to increase absorbency}. When our method of towel construction set out above is carried out to add the polyester all of the benefits described in our copending Patent Application are realized including:

Dramatic decreases in linting.

Reductions in laundry cost (mainly in drying).

Greater longevity.

All of these benefits are even more dramatic with increased levels of polyester.

Tub Mats

Tub mats have always represented a handling problem in a laundry system. Their typical heavier weight construction results in the mats not dry in the same time as the toweling. Therefore they must be sorted at the end of a drying cycle and run through another cycle. We have varied the polyester percentage in the yarns up to about 45–55% and preferably less than or equal to about 50% for tub mats in an effort to equalize drying times and institutional customers are very pleased with the results. Equalizing the drying time removes a major problem for their laundries. This market sector is not as sensitive to the loss in absorbency of a tub mat as a result of decreasing the amount of cotton in the mat as has been past experience with towels; since a mats primary function is to catch water from the body dropped onto the floor as opposed to actually drying the body. Higher polyester percentages in mats are therefore are more readily accepted by the market since the product is not handled to the same extent as a towel.

Low Lint Towels

For some of our current toweling product ensembles, we have been varying the polyester percentages to up to about 25–35% and preferably less than or equal to about 30%. One of our distributors has been quite enthusiastic about the higher polyester content toweling products that he requested exclusive rights to this product for specific markets. The product benefits and the associated reduction in risk of fire in the laundry has been very well received in the healthcare and cruise line industries among others and their particular desire to reduce the lint generated from cotton fibers breaking away from a toweling products.

100% Cotton Towels

We have discovered in spite of our best efforts that there are buyers, regardless of our products benefits, that are not willing to change from a 100% cotton towel ensemble. It is their position that the 100% cotton product provides an image of superior performance and high quality in the minds of their customers. Therefore they do not purchase anything other than 100% cotton products.

However, these very same customers desire the colourfastness achieved with Fibertone™ products. We were not successful initially, as of about December 2000, in obtaining even shades of colour when using polyester percentages below 8%. With selected colours, we have been able to produce a good quality of colour with less than or equal to about 8% polyester. We are now manufacturing a towel with less than or equal to about 5% "solution dyed polyester". There are no basic benefits to this product, other than colourfastness. Since the polyester serves as no enhancement to the towel, other than colour, it is considered "ornamentation." Thus the product can be labeled as 100% cotton, according to the labeling laws, and will meet the needs of this group of customers. The label reads "100% cotton (exclusive of 5% polyester ornamentation)".

Institutional terry/toweling products described herein may be for example institutional towels, whether hand, bath, face, wash cloth or the like, bath robes, tub mats, heavier towels, or "100%" cotton toweling as described above. Depending on the product desired the ratio of pre-dyed polyester to cotton may be preferably in the range of 8–14%, in another embodiment in a ratio of less than or equal to about 5% of the pre-dyed polyester fibers with the balance being the cotton fiber; in yet another embodiment in a ratio of less than or equal to about 8% of the pre-dyed polyester fibers with the balance being the cotton fiber; in yet another embodiment in a ratio of about 25–35% and preferably less than or equal to about 30% of the pre-dyed polyester fibers with the balance being the cotton fiber; in another embodiment in a ratio of about 45–55% and preferably less than or equal to about 50% of the pre-dyed polyester fibers with the balance being the cotton fiber.

As many changes can be made to the preferred embodiment of the invention without departing from the scope thereof; it is intended that all matter contained herein be considered illustrative of the invention and not in a limiting sense.

The embodiments of the invention in which an exclusive property or privilege is claimed are as follows:

1. A colored institutional terry/toweling product which comprises colored yarns draw blended of a pre-determined amount of pre-dyed polyester fiber with the remainder being natural cotton fibers resulting in a yarn of pre-determined color, said product having ground warp, fill, and terry loop fibers manufactured from said yarn resulting in said product having a pre-determined color which is color fast, has little variance from lot to lot, may be washed and bleached, is conveniently handled by an institution, has an increased life expectancy imparted by the polyester, and which has reproducible color of the finished product from batch to batch wherein a ratio of less than or equal to about 5% of pre-dyed polyester fibers with the balance being the cotton fiber is utilized in manufactured the yarns imparting the color to said product.

2. An institutional toweling product, comprising twisted yarn spun from an intimate, drawn blend of a predetermined amount of pre-dyed polyester fiber, with the balance being natural cotton fibre said colored yarn thereafter being spun from said drawn blend and all of said ground yarns, fill yarns and pile yarns making up said toweling product being formed from said drawn blended twisted colored yarn to form said institutional toweling product which has the properties of: 1) being colorfast; 2) being consistent in color from batch to batch; 3) being consistent in color from towel product type to towel product type, for example, for a bath towel, hand towel, wash clot, bath robe, and bath mat; 4) being capable of being bleached and washed without fading or loosing it's luster, and 5) having an extended life expectancy wherein a ratio of less than or equal to about 5% of pre-dyed polyester fibers with the balance being the cotton fiber is utilized in manufactured the yarns imparting the color to said product.

3. A colored institutional terry/toweling product which comprises colored yarns draw blended of a pre-determined amount of pre-dyed polyester fiber with the remainder being natural cotton fibers resulting in a yarn of pre-determined color, said product having ground warp, fill, and terry loon fibers manufactured from said yarn resulting in said product having a pre-determined color which is color fast, has little variance from lot to lot, may be washed and bleached, is conveniently handled by an institution, has an increased life expectancy imparted be the polyester, and which has reproducible color of the finished product from batch to batch wherein a ratio of less than or equal to about 8% of the pre-dyed polyester fibers with the balance being the cotton fiber is utilized in manufactured the yarns imparting the color to said product.

4. A colored institutional terry/toweling product which comprises colored yarns draw blended of a pre-determined amount of pre-dyed polyester fiber with the remainder being natural cotton fibers resulting in of pre-determined color, said product having ground warp, fill, and terry loop fibers manufactured from said yarn resulting in said product having a pre-determined color which is color fast, has little variance from lot to lot, may be washed and bleached, is conveniently handled by an institution, has an increased life expectancy imparted by the polyester, and which has reproducible color of the finished product from batch to batch wherein a ratio of about 25–35% and preferably less than or equal to about 30% of the pre-dyed polyester fibers with the balance being the cotton fiber is utilized in manufactured the yarns imparting the color to said product.

5. A colored institutional terry/toweling product which comprises colored yarns draw blended of a pre-determined amount of pre-dyed polyester fiber with the remainder being natural cotton fibers resulting in a vein of pre-determined color, said product having around warp, fill, and terry loop fibers manufactured from said yarn resulting in said product having a pre-determined color which is color fast, has little variance from lot to lot, maybe washed and bleached, is conveniently handled by an institution, has an increased life expectancy imparted by the polyester, and which has reproducible color of the finished product from batch to batch wherein a ratio of about 45–55% and preferably less than or equal to about 50% of the pre-dyed polyester fibers with the balance being the cotton fiber is utilized in manufactured the yarns imparting the color to said product.

6. The product of claim 5 wherein a blend of 2 different colors of pre-dyed polyester is utilized to be certain the color matches the other pieces of the ensemble.

7. The product of claim 6 further comprising a tub mat having about 45–55% and preferably less than or equal to about 50% overall polyester, but utilizing about 14% brown and about 36% white polyester to maintain the proper color matching.

8. A colored institutional terry/toweling product of claims 1, 3, 4, or 8 wherein complete bath ensembles can be provided to the institution with matching colors for the hand towel, the bath towel, the hand towel and the bath mats.

9. A process for manufacturing institutional terry/toweling products having improved colour fastness and durability comprising the steps of:

1. providing cotton fibers;
2. providing pre-dyed polyester fibers;
3. orienting the fibers of the cotton in substantially a uniform parallel direction by carding;
4. orienting the pre-dyed polyester fibers in substantially parallel direction by a carding process;
5. draw blending the cotton and pre-dyed polyester fibers in a slivering process;
6. following the intimate draw blending of the pre-dyed polyester and cotton fibers spinning the slivered fibers into twisted yarns having a pre-determined color which will be imparted to the toweling product;
7. accumulating the yarns on a loom beam following warping/slashing the yarns in preparation for the weaving process;
8. weaving said colored yarn into the ground warp, the fill and the pile warp yarns in the toweling product which preferably is a continuous process;
9. bleaching and subsequently washing and drying said toweling product prior to finishing;

wherein the color in the imparted to the institutional toweling product is obtained by the weaving of said draw blended yarn only with no subsequent dying process being necessary and wherein the resulting products have:

v) a minimum color variation from batch to batch, vi) improved colour fastness, the color being imparted to the toweling product by the pre-dyed polyester fiber allowing all institutional towels resulting from this process to be able to be washed and handled together, vii) a significantly longer life expectancy of the toweling product imparted by the pre-dyed polyester fiber, and the ability of the toweling product to be manufactured into a matching set of toweling products having minimum color variation from product to product wherein a ratio of less than or equal to about 5% of pre-dyed polyester fibers with the balance being the cotton fiber is utilized in manufactured the yarns imparting the color to said product.

10. A process for manufacturing institutional terry/toweling products having improved colour fastness and durability comprising the steps of:

1. providing cotton fibers;
2. providing pre-dyed polyester fibers;
3. orienting the fibers of the cotton in substantially a uniform parallel direction by carding;
4. orienting the pre-dyed polyester fibers in substantially parallel direction by a carding process;
5. draw blending the cotton and pre-dyed polyester fibers in a slivering process following the intimate draw blending of the pre-dyed polyester and cotton fibers spinning the slivered fibers into twisted yarns having a pre-determined color which will be imparted to the toweling product;
7. accumulating the yarns on a loom beam following warping/slashing the yarns in preparation for the weaving process;
8. weaving said colored yarn into the ground warp, the fill and the pile warp yarns in the toweling product which preferably is a continuous process;
9. bleaching and subsequently washing and drying said toweling product prior to finishing;

wherein the color in the imparted to the institutional toweling product is obtained by the weaving of said draw blended yarn only with no subsequent dying process being necessary and wherein the resulting products have:

viii) a minimum color variation from batch to batch, ix) improved colour fastness, the color being imparted to the toweling product by the pre-dyed polyester fiber allowing all institutional towels resulting from this process to be able to be washed and handled together, x) a significantly longer life expectancy of the toweling product imparted by the pre-dyed polyester fiber, and the ability of the toweling product to be manufactured into a matching set of toweling products having minimum color variation from product to product wherein a ratio of less than or equal to about 8% of the pre-dyed polyester fibers with the balance being the cotton fiber is utilized in manufactured the yarns imparting the color to said product.

11. A process for manufacturing institutional terry/toweling products having improved colour fastness and durability comprising the steps of:

1. providing cotton fibers;
2. providing pre-dyed polyester fibers;
3. orienting the fibers of the cotton in substantially a uniform parallel direction by carding;
4. orienting the pre-dyed polyester fibers in substantially parallel direction by a carding process;
5. draw blending the cotton and pre-dyed polyester fibers in a slivering process;
6. following the intimate draw blending of the pre-dyed polyester and cotton fibers spinning the slivered fibers into twisted yarns having a pre-determined color which will be imparted to the toweling product;
7. accumulating the yarns on a loom beam following warping/slashing the yarns in preparation for the weaving process;
8. weaving said colored yarn into the ground warp, the fill and the pile warp yarns in the toweling product which preferably is a continuous process
9. bleaching and subsequently washing and drying said toweling product prior to finishing:

wherein the color in the imparted to the institutional toweling product is obtained by the weaving of said draw blended yarn only with no subsequent dying process being necessary and wherein the resulting products have:

xi) a minimum color variation from batch to batch, xii) improved colour fastness, the color being imparted to the toweling product by the pre-dyed polyester fiber allowing all institutional towels resulting from this process to be able to be washed and handled together, xiii) a significantly longer life expectancy of the toweling product imparted by the pre-dyed polyester fiber, and the ability of the toweling product to be manufactured into a matching set of toweling products having minimum color variation from product to product wherein a ratio of about 25–35% and preferably less than or equal to about 30% of the pre-dyed polyester fibers with the balance being the cotton fiber is utilized in manufactured the yarns imparting the color to said product.

12. A process for manufacturing institutional terry/toweling products having improved colour fastness and durability comprising the steps of:

1. providing cotton fibers;
2. providing pre-dyed polyester fibers;
3. orienting the fibers of the cotton in substantially a uniform parallel direction by carding;
4. orienting the pre-dyed polyester fibers in substantially parallel direction by a carding process;
5. draw blending the cotton and pre-dyed polyester fibers in a slivering process;
6. following the intimate draw blending of the pre-dyed polyester and cotton fibers spinning the slivered fibers into twisted yarns having a pre-determined color which will be imparted to the toweling product;
7. accumulating the yarns on a loom beam following warping/slashing the yarns in preparation for the weaving process;
8. weaving said colored yarn into the ground warp, the fill and the pile warp yarns in the toweling product which preferably is a continuous process;
9. bleaching and subsequently washing and drying said toweling product prior to finishing;

wherein the color in the imparted to the institutional toweling product is obtained by the weaving of said draw blended yarn only with no subsequent dying process being necessary and wherein the resulting products have:

xiv) a minimum color variation from batch to batch, xv) improved colour fastness, the color being imparted to the toweling product by the pre-dyed polyester fiber allowing all institutional towels resulting from this process to be able to be washed and handled together, xvi) a significantly longer life expectancy of the toweling product imparted by the pre-dyed polyester fiber, and the ability of the toweling product to be manufactured into a matching set of toweling products having minimum color variation from product to product wherein a ratio of about 45–55% and preferably less than or equal to about 50% of the pre-dyed polyester fibers with the balance being the cotton fiber is utilized in manufactured the yarns imparting the color to said product.

13. The method of claim 12 wherein a blend of 2 different colors of pre-dyed polyester is utilized to be certain the color matches the other pieces of the ensemble.

14. The method of claim 13 further comprising a tub mat having about 45–55% and preferably less than or equal to about 50% overall polyester, but utilizing about 14% brown and about 36%, white polyester to maintain the proper color matching.

15. A colored institutional terry/toweling product comprising ground warp, fill, and pile warped yarns, all of said yarns being colored by intimately draw blending a predetermined amount of pre-dyed polyester fiber with cotton fiber when the yarn is spun and twisted to thereby form a predetermined color for the institutional towel wherein a ratio of less than or equal to about 5% of pre-dyed polyester fibers with the balance being the cotton fiber is utilized in manufactured the yarns imparting the color to said product.

16. An institutional toweling product, comprising twisted yarn spun from an intimate, drawn blend of a predetermined amount of pre-dyed polyester fiber, with the balance being natural cotton fibre said colored yarn thereafter being spun from said drawn blend and all of said ground yarns, fill yarns and pile yarns making up said toweling product being formed from said drawn blended twisted colored yarn to form said institutional toweling product which has the properties of: 1) being colorfast; 2) being consistent in color from batch to batch; 3) being consistent in color from towel product type to towel product type, for example, for a bath towel, hand towel, wash cloth, bath robe, and bath mat; 4) being capable of being bleached and washed without fading or loosing it's luster; and 5) having an extended life expectancy wherein a ratio of less than or equal to about 8% of the pre-dyed polyester fibers with the balance being the cotton fiber is utilized in manufactured the yarns imparting the color to said product.

17. An institutional toweling product, comprising twisted yarn spun from an intimate, drawn blend of a predetermined amount of pre-dyed polyester fiber, with the balance being natural cotton fibre said colored yarn thereafter being spun from said drawn blend and all of said ground yarns, fill yarns and pile yarns making up said toweling product being formed from said drawn blended twisted colored yarn to form said institutional toweling product which has the properties of: 1) being colorfast; 2) being consistent in color from batch to batch; 3) being consistent in color from towel product type to towel product type, for example, for a bath towel, hand towel, wash cloth, bath robe, and bath mat; 4) being capable of being bleached and washed without fading or loosing it's luster; and 5) having an extended life expectancy wherein a ratio of about 25–35% and preferably less than or equal to about 30% of the pre-dyed polyester fibers with the balance being the cotton fiber is utilized in manufactured the yarns imparting the color to said product.

18. An institutional toweling product, comprising twisted yarn spun from an intimate, drawn blend of a predetermined amount of pre-dyed polyester fiber, with the balance being natural cotton fibre said colored yarn thereafter being spun from said drawn blend and all of said ground yarns, fill yarns and pile yarns making up said toweling product being formed from said drawn blended twisted colored yarn to form said institutional toweling product which has the properties of: 1) being colorfast; 2) being consistent in color from batch to batch; 3) being consistent in color from towel product type to towel product type, for example, for a bath towel, hand towel, wash cloth, bath robe, and bath mat; 4) being capable of being bleached and washed without fading or loosing it's luster; and 5) having an extended life expectancy wherein a ratio of about 45–55% and preferably less than or equal to about 50% of the pre-dyed polyester fibers with the balance being the cotton fiber is utilized in manufactured the yarns imparting the color to said product.

19. The product of claim 18 wherein a blend of 2 different colon of pre-dyed polyester is utilized to be certain the color matches the other pieces of the ensemble.

20. The product of claim 19 further comprising a tub mat having about 45–55% and preferably less than or equal to about 50% overall polyester, but utilizing about 14% brown and about 36% white polyester to maintain the proper color matching.

21. An institutional toweling product of claims 16, 17, or 18 wherein complete bath ensembles can be provided to the institution with matching colors for the hand towel, the bath towel, the hand towel and the bath mats.

22. A method of coloring an institutional terry/toweling product comprising weaving said product from twisted yarn spun from an intimate, drawn blend of a predetermined amount of pre-dyed polyester fiber, said colored yarn thereafter being spun from said drawn blend and all of said ground yarns, fill yarns and pile yarns making up said product being formed from said drawn blended twisted colored yarn to form said product which has the properties of: 1) being colorfast; 2) being consistent in color from batch to batch; 3) being consistent in color from product type to product type, for example, for a bath towel, face towel, wash cloth, bath robe or bath mat; 4) being capable of being bleached and washed without fading or loosing it's luster; and 5) having an extended life expectancy wherein a ratio of less than or equal to about 5% of pre-dyed polyester fibers with the balance being the cotton fiber is utilized in manufactured the yarns imparting the color to said product.

23. A method of coloring an institutional terry/toweling product comprising weaving said product from twisted yarn spun from an intimate, drawn blend of a predetermined amount of pre-dyed polyester fiber, said colored yarn thereafter being spun from said drawn blend and all of said ground yarns, fill yarns and pile yarns making up said which has the properties of: 1) being colorfast; 2) being consistent in color from batch to batch 3) being consistent in color from product type to product type, for example, for a bath towel, face towel, wash cloth, bath robe or bath mat; 4) being capable of being bleached and washed without fading or loosing it's luster; and 5) having an extended life expectancy wherein a ratio of less than or equal to about 8% of the pre-dyed polyester fibers with the balance being the cotton fiber is utilized in manufactured the yarns imparting the color to said products.

24. A method of coloring an institutional terry/toweling product comprising weaving said product from twisted yarn spun from an intimate, drawn blend of a predetermined amount of pre-dyed polyester fiber, said colored yarn thereafter being spun from said drawn blend and all of said ground yarns, fill yarns and pile yarns making up said product being formed from said drawn blended twisted colored yarn to form said product which has the properties of: 1) being colorfast; 2) being consistent in color from batch to batch; 3) being consistent in color from product type to product type, for example, for a bath towel, face towel, wash cloth, bath robe or bath mat; 4) being capable of being bleached and washed without fading or loosing it's luster; and 5) having an extended life expectancy wherein a ratio of about 25–35% and preferably less than or equal to about 30% of the pre-dyed polyester fibers with the balance being the cotton fiber is utilized in manufactured the yarns imparting he color to said product.

25. A method of coloring an institutional terry/toweling product comprising weaving said product from twisted yarn spun from an intimate, drawn blend of a predetermined amount of pre-dyed polyester fiber, said colored yarn thereafter being spun from said drawn blend and all of said ground yarns, fill yarns and pile yarns making up said product being formed from said drawn blended twisted colored yarn to form said product which has the properties of: 1) being colorfast; 2) being consistent in color from batch to batch; 3) being consistent in color from product type to product type, for example, for a bath towel, face towel, wash cloth, bath robe or bath mat; 4) being capable of being bleached and washed without fading or loosing it's luster; and 5) having an extended life expectancy wherein a ratio of about 45–55% and preferably less than or equal to about 50% of the pre-dyed polyester fibers with the balance being the cotton fiber is utilized in manufactured the yarns imparting the color to said product.

26. The method of claim 25 wherein a blend of 2 different colors of pre-dyed polyester is utilized to be certain the color matches the other pieces of the ensemble.

27. The method of claim 26 further comprising a tub mat having about 45–55% and preferably less than or equal to about 50% overall polyester, but utilizing about 14% brown and about 36% white polyester to maintain the proper color matching.

28. A colored institutional terry/toweling product comprising ground warp, fill, and pile warped yarns, all of said yarns being colored by intimately draw blending a predetermined amount of pre-dyed polyester fiber with cotton fiber when the yarn is spun and twisted to thereby form a predetermined color for the institutional towel wherein a ratio of less than or equal to about 8% of the pre-dyed polyester fibers with the balance being the cotton fiber is utilized in manufactured the yarns imparting the color to said product.

29. A colored institutional terry/toweling product comprising ground warp, fill, and pile warped yarns, all of said yarns being colored by intimately draw blending a predetermined amount of pre-dyed polyester fiber with cotton fiber when the yarn is spun and twisted to thereby form a predetermined color for the institutional towel wherein a ratio of about 25–35% and preferably less than or equal to about 30% of the pre-dyed polyester fibers with the balance being the cotton fiber is utilized in manufactured the yarns imparting the color to said product.

30. A colored institutional terry/toweling product comprising ground warp, fill, and pile warped yarns, all of said yarns being colored by intimately draw blending a predetermined amount of pre-dyed polyester fiber with cotton fiber when the yarn is spun and twisted to thereby form a predetermined color for the institutional towel wherein a ratio of a bout 45–55% and preferably less than or equal to about 50% of the pre-dyed polyester fibers with the balance being the cotton fiber is utilized in manufactured the yarns imparting the color to said product.

31. The colored institutional terry/toweling product of claim 30 wherein a blend of 2 different colors of pre-dyed polyester is utilized to be certain the color matches the other pieces of the ensemble.

32. The colored institutional terry/toweling product of claim 31 further comprising a tub mat having about 45–55% and preferably less than or equal to about 50% overall polyester, but utilizing about 14% brown and about 36% white polyester to maintain the proper color matching.

* * * * *